United States Patent [19]

Surbaugh

[11] 3,993,280

[45] Nov. 23, 1976

[54] DRAFTING STOOL

[75] Inventor: Richard M. Surbaugh, Lake Ozark, Mo.

[73] Assignee: Paul R. Distler, Lake Ozark, Mo. ; a part interest

[22] Filed: Nov. 10, 1975

[21] Appl. No.: 630,301

[52] U.S. Cl. ..... 248/405; 104/148 R; 105/61; 105/108; 248/416; 248/419; 248/430; 297/346

[51] Int. Cl.[2] ..... F16M 11/00

[58] Field of Search ..... 74/424.8 R; 104/148 R; 105/61, 108, 119; 108/147; 180/77 S, 77 H, 77 HT; 248/158, 161, 404, 405, 416, 415, 424, 425, 429, 430; 297/330, 344–348

[56] References Cited

UNITED STATES PATENTS

| | | | |
|---|---|---|---|
| 1,194,551 | 8/1916 | Schossler | 248/430 X |
| 2,590,251 | 3/1952 | Hoover | 74/424.8 R |
| 2,655,981 | 10/1953 | Whittingham et al. | 297/345 X |
| 2,829,002 | 4/1958 | Leavengood et al. | 248/429 X |
| 3,191,990 | 6/1965 | Rugg et al. | 297/330 X |
| 3,259,355 | 7/1966 | Slouka | 248/430 |
| 3,304,609 | 2/1967 | Horowitz et al. | 108/147 X |
| 3,466,411 | 9/1969 | Martin | 297/330 X |
| 3,690,697 | 9/1972 | Bohanski | 180/77 S X |
| 3,807,795 | 4/1974 | Weant et al. | 297/330 |
| 3,891,269 | 6/1975 | Moeser | 248/430 X |

FOREIGN PATENTS OR APPLICATIONS

| | | | |
|---|---|---|---|
| 812,815 | 9/1951 | Germany | 297/344 |
| 115,182 | 10/1945 | Sweden | 248/430 |
| 262,231 | 6/1949 | Switzerland | 297/344 |
| 246,629 | 1/1947 | Switzerland | 248/430 |
| 288,257 | 8/1971 | U.S.S.R. | 248/430 |

*Primary Examiner*—Lawrence J. Staab
*Attorney, Agent, or Firm*—John A. Hamilton

[57] ABSTRACT

A drafting stool having electric motors both for moving it along the floor parallel to the forward edge of a drafting table, and for changing the elevation of the seat. Provision is made for guiding its travel along the floor, for preventing overturning thereof, for initiating any desired adjusting movement by the occupant's lurching of his weight in various directions, and for bringing the stool to a halt at any desired position of adjustment either manually, or by means of preset limit control devices.

5 Claims, 7 Drawing Figures

DRAFTING STOOL

This invention relates to new and useful improvements in drafting stools, and has as its principal object the provision of a motorized stool including power means operable to move it along the supporting floor in a line parallel to the forward edge of a drafting table.

Draftsmen commonly sit upon a stool before the drafting table as they work, in order to reduce fatigue and enjoy greater comfort as they work. However, drafting tables 10 or 12 feet wide are not uncommon, which requires in many cases that the stool be moved frequently in order that the draftsman occupying it may have ready access to different portions of the table, and the necessity of moving the stool manually from time to time can itself be a source of fatigue and annoyance. A stool having motorized means for moving it along the forward edge of the table, and controlled by the occupant of the stool, does much to alleviate these problems.

Another object is the provision of a drafting stool of the character described also having motorized means, also controlled by the occupant, for adjusting the elevation of the seat relative to the drafting table. Many draftsmen prefer to sit at a lower elevation when working on the forward portion of the table, and at a higher elevation when working on the rearward portion of the table.

A further object is the provision of a drafting stool of the character described wherein the various adjusting movements of the stool can be accomplished by means not requiring use of the occupant's hands. To this end, means are provided whereby the occupant may initiate any adjusting movement he desires, such as left, right, up or down, simply by lurching or swaying his weight gently in one direction or another, such as left for left movement, right for right movement, forward for up movement, and rearward for down movement. Any movement, once so initiated, is automatically continued, until terminated either by operation of a foot-operated pushbutton, or automatically by pre-set adjustable limit controls.

Other objects are simplicity and economy of construction, and efficiency and dependability of operation.

Figure 1:
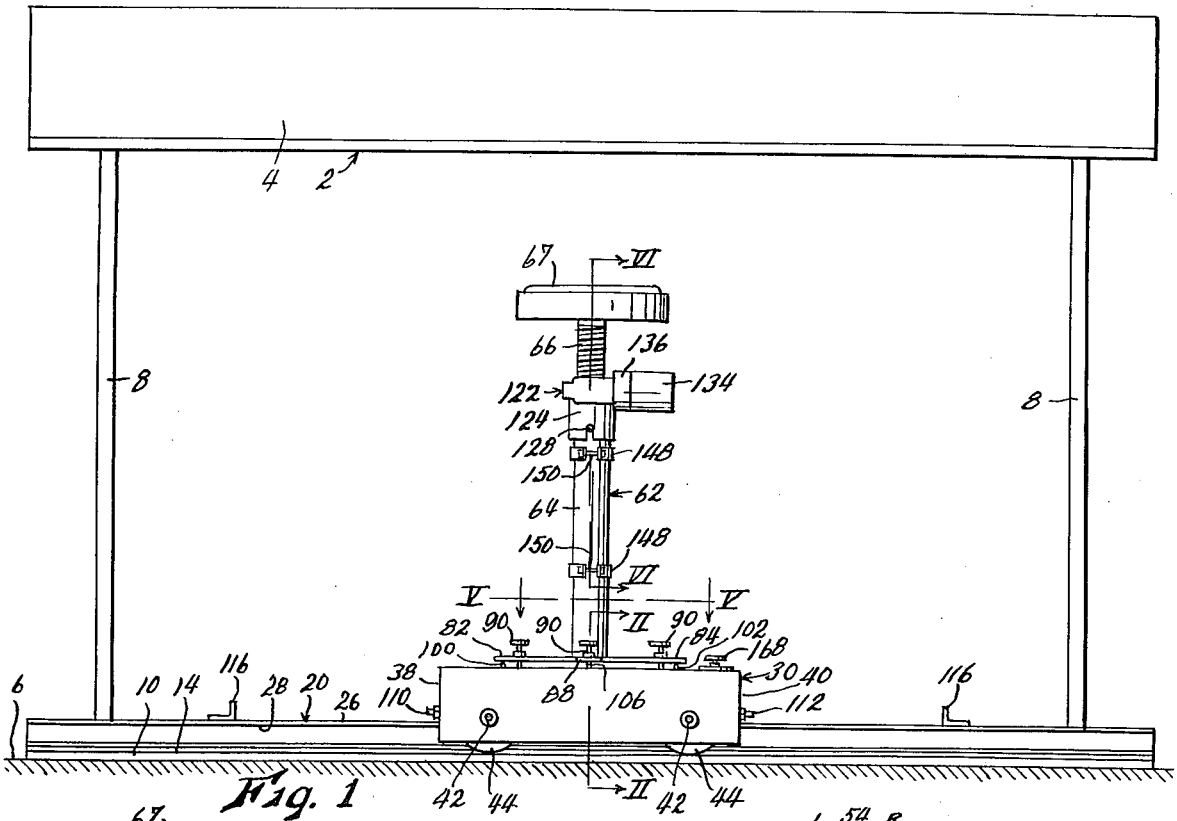
Figure 6:
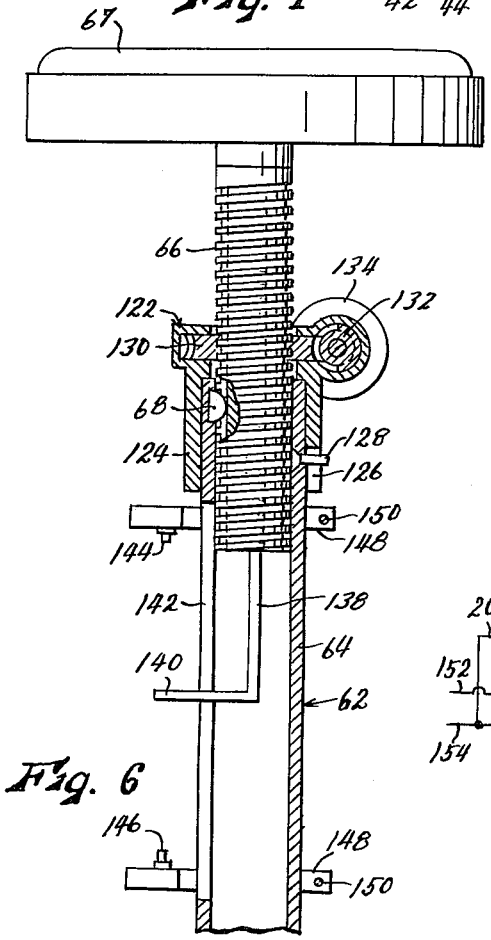
Figure 7:
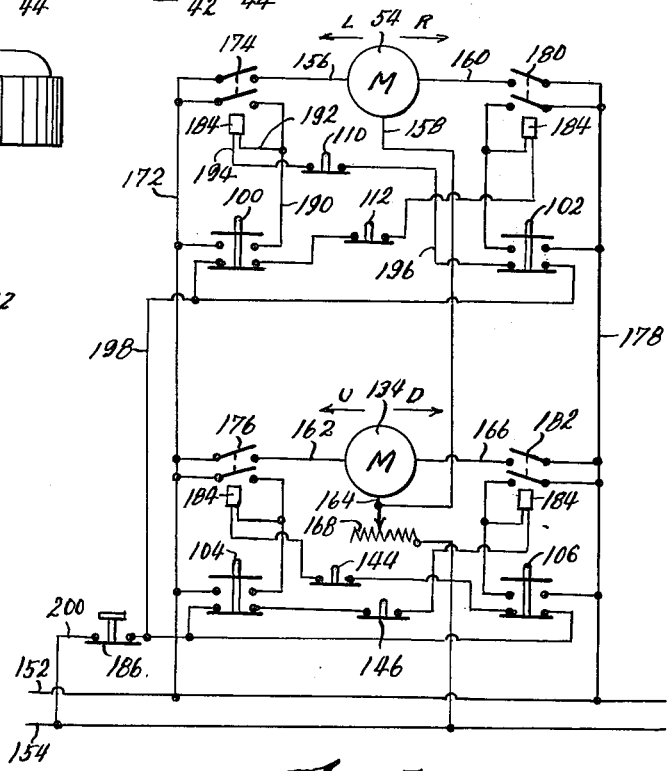
Figure 2:
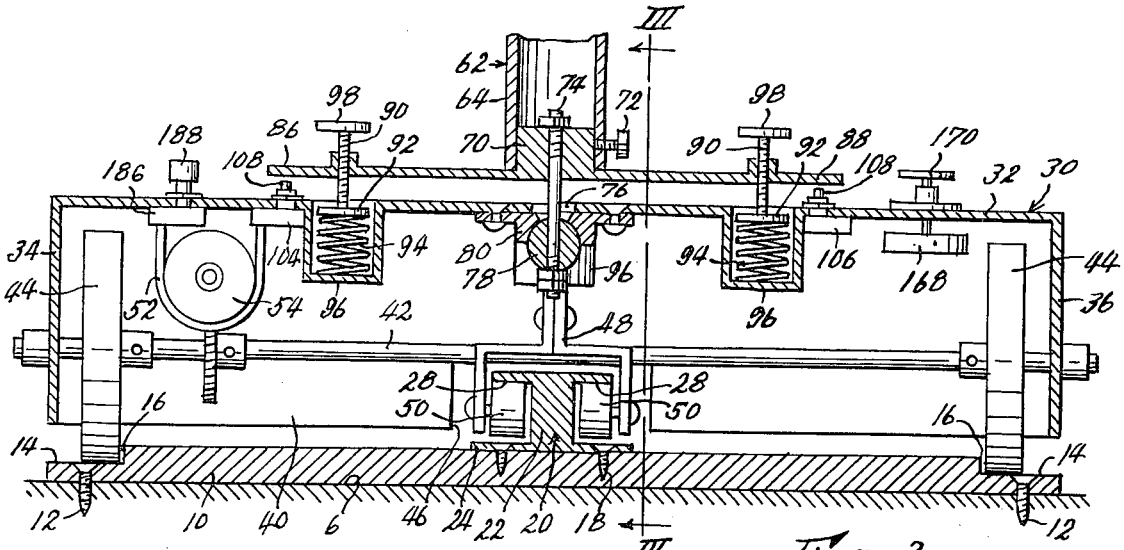
Figure 3:
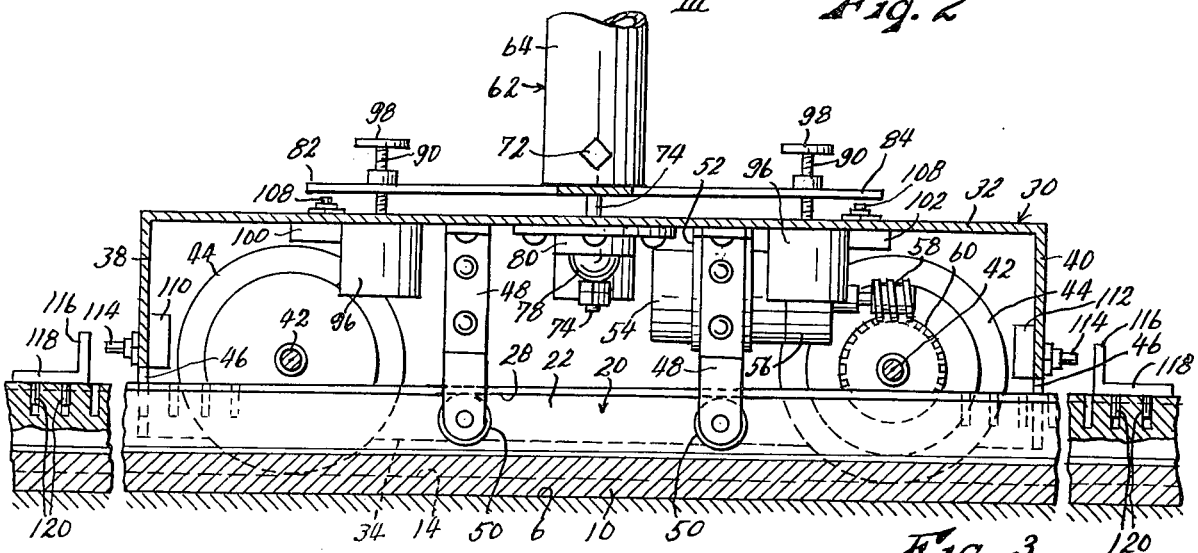
Figure 5:
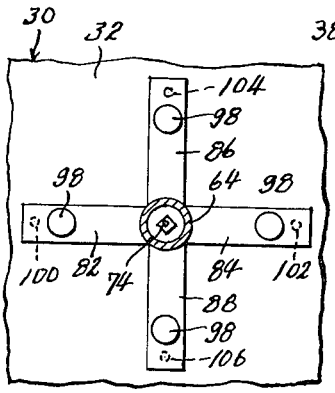
Figure 4:
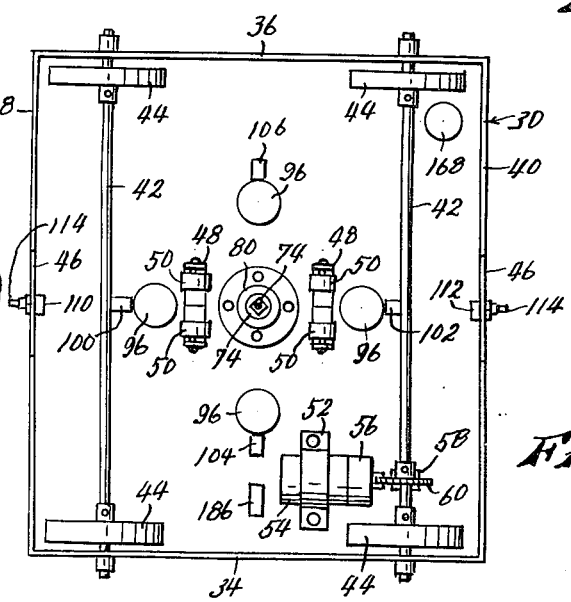

With these objects in view, as well as other objects which will appear in the course of the specification, reference will be had to the accompanying drawing, wherein:

FIG. 1 is a front elevational view of a drafting table, showing a drafting stool embodying the present invention disposed in operative relationship thereto, FIG. 2 is an enlarged, fragmentary sectional view taken on line II—II of FIG. 1, FIG. 3 is a sectional view taken on line III—III of FIG. 2, partially broken away and foreshortened, FIG. 4 is an inverted plan view of the stool base, to a scale reduced from that of FIGS. 2 and 3, FIG. 5 is an enlarged, fragmentary sectional view taken on line V—V of FIG. 1, FIG. 6 is an enlarged, fragmentary sectional view taken on line VI—VI of FIG. 1, and FIG. 7 is a schematic wiring diagram of the electrical control system of the stool.

Like reference numerals apply to similar parts throughout the several views, and the numeral 2 applies generally to a drafting table, here shown very simply as a planar table-top slab 4, sloping upwardly from its forward edge to its rearward edge, and supported above floor 6 by table legs 8. The drafting stool contemplated by the present invention preferably includes a base track member 10 consisting of a flat, elongated board of wood or the like lying flat on floor 6, extending parallel to the forward edge of table slab 4 forwardly thereof, and adapted to be affixed to said floor as by screws 12 (see FIG. 2). The longitudinal edge portions of said track member are reduced in thickness to provide runways 14 for the stool wheels, as will be described, forming outwardly facing shoulders 16 at the inner edge of each of said runways. Extending longitudinally along base track 10 at the transverse midline thereof, and affixed thereto as by screws 18, is a secondary track member 20 of steel or the like. Said secondary track member is of I-shaped cross-sectional contour, having a vertical web 22, a bottom flange 24 lying against base track 10 and adapted to receive screws 18, and a top flange 26 forming downwardly facing track surfaces 28 at respectively opposite sides of web 22. Both track members have a length corresponding generally to the width of table slab 4.

Movable along the track members is a stool base indicated generally by the numeral 30, said base being rigid and having the form of a rectilinear box, open at its bottom, and including a top wall 32, front wall 34, rear wall 36, and side walls 38 and 40. Adjacent each side of the base, an axle 42 extends horizontally between the front and rear walls of the base, said axles being journalled rotatably in said front and rear walls. Each axle has affixed thereto a pair of rubber-tired wheels 44, the two wheels of each axle resting respectively on the two runways 14 of base track 10, closely adjacent shoulders 16. Thus, as stool base 30 is moved along the track by means to be described, shoulders 16 insure straight-line travel of said base. The side walls 38 and 40 of the stool base are notched, as indicated at 46, to accomodate secondary track member 20. Affixed to the lower side of top wall 32 of the base are a plurality of brackets 48 each carrying a pair of roller wheels 50 disposed at respectively opposite sides of secondary track 20 and engaging track surfaces 28 of said secondary track. Said roller wheels are rotatable on axes parallel to axles 42, and serve to hold base wheels 44 downwardly against base track runways 14, and hence to prevent tilting or overturning of the base. Fixed within base 30, as by bracket 52, is a prime mover 54, preferably a reversible electric motor, although hydraulic or pneumatic motors would function satisfactorily. When actuated, said prime mover acts through a geared speed reducer 56 to turn a worm gear 58 which is meshed with a worm wheel 60 fixed on one of axles 42, whereby to drive the stool base along the tracks.

Extending upwardly from the midpoint of stool base 30 is a generally vertical standard indicated by the numeral 62, and comprising a lower section 64 which may constitute a length of smooth pipe, and an upper section 66 constituting an externally threaded screw telescoped slidably into lower section 64 but prevented from rotating therein by key 68, see FIG. 6. Screw 66 extends upwardly from pipe 64 and has a swivel seat 67 mounted at the upper end thereof. Lower section 64 terminates above top wall 32 of the base, and has a plug 70 fixed in its lower end by set screw 72. A generally vertical bolt 74 is fixed in said plug and extends downwardly through a hole 76 formed in top base wall 32 (see FIG. 2) and is fixed at its lower end in a spherical ball member 78 seated in a downwardly opening hemispherical socket member 80 affixed to the lower surface of top wall 32. Thus the standard is universally pivoted to stool base 30. Extending radially from plug 70, just above base 30, are four horizontal arms, two of said arms being designated 82 and 84 and extending respectively left and right from the standard, and two of said arms being designated 86 and 88 and extending respectively forwardly and rearwardly from the standard. Adjacent the outer end of each arm, a vertical screw 90 is threaded in said arm, extending both upwardly and downwardly therefrom. At its lower end, each screw 90 is provided with a foot member 92 bearing against a vertical compression spring 94 contained in an upwardly opening socket member 96 formed in top wall 32 of the base. Each screw is provided at its upper end with a hand-operated turning knob 98. By turning screws 90 to adjust the tension of springs 94 properly, the standard may be held accurately vertical, with screws 90 in compression and pivot bolt 74 in tension, despite variations in the weight of a person occupying seat 67, but said person may cause the standard to tilt slightly in any horizontal direction by swaying or lurching his weight in that direction. Disposed beneath top base wall 32 are four micro-switches, two of said micro-switches being designated 100 and 102 and disposed respectively beneath the outer ends of arms 82 and 84, and two of said micro-switches being designated 104 and 106 and disposed respectively beneath the outer ends of arms 86 and 88. As best shown in FIGS. 2 and 3, the body portions of said micro-switches are mounted beneath top wall 32, and each includes an operating pushbutton 108 extending above said top wall. As diagrammed in FIG. 7, each of said micro-switches has a pair of normally open contacts and a pair of normally closed contacts, adapted respectively to be closed and opened by depression of its pushbutton 108. Also mounted in side walls 38 and 40 of the base, respectively directly above notches 46 thereof, are a pair of normally closed micro-switches 110 and 112, mounted within the base but each including an operating pushbutton 114 extending exteriorly of the base in a direction parallel to the direction of base travel, and operable when depressed to open the related switch. Switches 110 and 112 serve as limit switches for the travel of the stool base, as will appear, and each is adapted to be opened by an upstanding switch operator 116 carried by secondary track 20 at the same side of said base. As best shown in FIG. 3, each operator 116 is provided with a foot 118 from which depend a pair of parallel pins 120 adapted to be inserted slidably and downwardly into any adjacent pair of a series of sockets formed in track 20 in longitudinally spaced relation therealong. Said sockets extend downwardly into web 22 of the track, which is thickened for this purpose. Thus whenever stool base 30 moves far enough along the tracks in either direction, the switch 110 or 112 at its leading side will be engaged and opened by one of operators 116 to bring the stool base to a halt, as will appear.

A housing indicated generally by the numeral 122 is provided with a downwardly opening socket portion 124 engaged over the top end portion of lower standard section 64, and prevented from rotating thereon by the engagement of a notch 126 thereof over a pin 128 fixed in the standard. As best shown in FIG. 6, housing 122 carries a nut 130 rotatably therein, said nut being threaded on screw 66 and being externally toothed to constitute a worm wheel with which is meshed a worm gear 132 also carried rotatably in housing 122 and driven by a reversible electric motor 134 or other prime mover through a geared speed reducer 136, said motor and reducer also being mounted on housing 122. Thus whenever motor 134 is activated in respectively opposite directions, screw 66 is moved upwardly or downwardly to change the elevation of seat 67 relative to the floor.

A limit control member 138 (see FIG. 6) is affixed to the lower end of screw 66 within standard section 64, and includes an arm 140 projecting radially outwardly through a longitudinally elongated slot 142 of said standard section. On upward movement of the seat, arm 140 engages a normally closed micro-switch 144 to open it, and on downward movement of the seat, arm 140 engages and opens a normally closed micro-switch 146. Micro-switches 144 and 146 are carried respectively by a pair of clamps 148 which are independently adjustable vertically along standard section 64, and securable thereon at any desired position by bolts 150. As will appear, opening of switches 144 or 146 deactivates motor 134. Thus, switches 100, 102, 110 and 112 control motor 54, while switches 104, 106, 144 and 146 control motor 134.

FIG. 7 shows a schematic wiring diagram of the electrical control system of the stool. Electrical line wires, which it will be understood are extended to stool base 30 by means of a flexible electric cable so as not to interfere with movement of said base along the tracks, are indicated at 152 and 154. It will be understood that motor 54 is of a type which operates in one direction when supplied with current across wires 156 and 158, and in the opposite direction when supplied with current across wires 160 and 158. These directions of operation represent respectively left and right movement of stool base 30. Similarly, motor 134 operates in one direction, representing upward movement of seat 67, when supplied with current across wires 162 and 164, and in the opposite direction when supplied with current across wires 166 and 164. Wires 158 and 164 are connected to line wire 154 through a manually adjustable rheostat 168, whereby the speed of operation of both motors may be adjusted. Conveniently, as best best shown in FIG. 2, rheostat 168 may be mounted in top wall 32 of base 30, and adjusted by means of a knob 170 disposed above said top wall.

Wires 156 and 162 are connected to line wire 152 by wire 172, each through one pole of a normally open, double-pole relay, the two relays being indicated respectively at 174 and 176, and wires 160 and 166 are connected to line wire 152 by wire 178, each through one pole of a normally open, double-pole relay, these relays being shown respectively at 180 and 182. It will be understood that all of the relays may be mounted within stool base 30, and that each relay includes a coil 184 operable by energization thereof to close both poles of said relay. The second pole of each relay is connected to the wire 172 or 178 supplying current to the first-name pole of said relay. Finally, the control system includes a normally closed stop switch 186 conveniently mounted within stool base 30 and, as best shown in FIG. 2, operable to open whenever the operator presses a pushbutton 188 disposed above said base with either foot.

Thus in operation, it will be seen that if the system is at rest, and the occupant desires to move to the left, he may do so by swaying or lurching his weight slightly to the left. This movement causes standard 62 to tilt slightly to the left on its universal pivot 78, against the tension of spring 94 at the left, so that arm 82 is lowered to press operating button 108 of switch 100, causing momentary closure of the normally open contacts and momentary opening of the normally closed contacts of said switch. The momentary closure of the normally open contacts completes a starting circuit from line wire 152 through wire 172, the normally open contacts of switch 100, wires 190 and 192, coil 184 of relay 174, wire 194, normally closed limit switch 110, wire 196, the normally closed contacts of switch 102, wire 198, stop switch 186 and wire 200 to line wire 154. Relay 174 thus is closed, the closure of one of its poles furnishing current to motor 54 to drive stool base 30 to the left, and the closure of its other pole by-passing the normally open contacts of switch 100 to complete a holding circuit maintaining relay 174 closed so that motor 54 continues in operation, driving the stool base to the left, until either pushbutton 114 of limit switch 110 engages left switch operator 116 to open said switch, or until the occupant of the seat opens stop switch 186, the opening of either of these switches allowing relay 174 to open to deactivate the motor. The speed of operation of the motor may be suited to the preference of the seat occupant by means of rheostat 168.

Similarly, if the operator sways his weight to the right, switch 102 is operated to close relay 180 to cause reverse operation of motor 54 to drive stool base 30 continuously to the right until halted by the opening of either right limit switch 112 or stop switch 186. Also, swaying of the seat occupant's weight forwardly or rearwardly will operate either switch 104 or 106 to close relays 176 or 182 to drive motor 134 respectively to raise or lower the seat continuously, until halted by the opening of either of vertical limit switches 144 or 146, or stop switch 186. However, the circuits in each case are virtually identical, and it is therefore believed that a detailed tracing of each would be unduly redundant.

It will be noted that the inclusion of the normally closed contacts of switch 102 in the holding circuit of relay 174, which was closed by switch 100, and the inclusion of the normally closed contacts of switch 100 in the holding circuit of relay 180, prevents the operator from energizing both circuits of motor 54 at the same time, which would damage the motor. That is, if he is moving to the left as previously described, and should sway his weight to the right, the opening of the normally closed contacts of switch 102 will interrupt the holding circuit of relay 174, allowing said relay to open, before relay 180 is closed. Both of motors 54 and 134 are of a type including a brake automatically applicable thereto whenever operating current is interrupted, so that there will be virtually no "overrun" or "coasting" thereof after current thereto is interrupted. Also, it will be noted that stop switch 186 is common to the holding circuits of all four relays, so that opening thereof will halt all movement of the stool seat 67, whether said movement be left, right, up or down.

While I have shown and described a specific embodiment of my invention, it will be readily apparent that many minor changes of structure and operation could be made without departing from the spirit of the invention.

What I claim as new and desire to protect by Letters Patent is:

1. A drafting stool comprising:

a. a base carrying floor-engaging wheels operable to support said base for linear movement in either of two opposite directions, and adapted to be placed before a drafting table for movement parallel to the forward edge of said table, b. a standard disposed above said base and projecting upwardly therefrom, c. means connecting the lower end of said standard to said base, said connecting means being pivotal to permit inclination of said standard from vertical in a vertical plane parallel to the direction of travel of said stool base, and including resilient means yieldably resisting said pivotal movement, d. a seat mounted on the upper end of said standard, e. a reversible prime mover mounted in said base, f. an operating connection between said prime mover and certain of said ground-engaging wheels, and g. control means whereby said prime mover may be started, stopped, and reversed, whereby said stool may be caused selectively to move in either direction in its line of travel, said control means including a pair of control devices carried by said base and operable to be actuated respectively by tilting of said standard in respectively opposite directions parallel to the direction of travel of said base, said control devices being operable when actuated to cause respectively opposite operation of said prime mover, whereby the occupant of the seat may actuate either control device by lurching slightly in one direction or the other.

2. A drafting stool as recited in claim 1 wherein said standard is vertically extensible in length, and with the addition of a second reversible prime mover operable when actuated in respectively opposite directions to cause vertical extension or retraction of said standard, and a second control system for said second prime mover, said standard connecting means also permitting pivotal movement of said standard in a vertical plane transverse to the direction of travel of the base, and including resilient means yieldably resisting said transverse pivotal movement, said second control means including a pair of control devices carried by said base and operable to be actuated respectively by said transverse tilting of said standard in respectively opposite directions, said last-named control devices being operable when actuated to cause operation of said second prime mover in respectively opposite directions, whereby the occupant of the seat may raise or lower said seat by lurching his weight in the appropriate direction.

3. A drafting stool as recited in claim 2 with the addition of means operable to adjust the tension of said resilient means resisting tilting of said standard, both parallel to the direction of travel of said stool base, and transversely thereto.

4. A drafting stool as recited in claim 2 with the addition of a single manually operable control device operable to deactivate both of said prime movers.

5. A drafting stool as recited in claim 2 wherein said means connecting the lower end of said standard to said base comprises:

a. a universal pivot connecting the lower end of the standard to the base, b. four arms projecting horizontally from said standard above said base, two of said arms extending parallel to the direction of base travel and two transversely thereto, c. a vertical screw threaded adjustably in the outer end portion of each of said arms and extending downwardly into a socket provided therefor in said base, and d. a compression spring disposed between the lower end of said screw and the base of said socket, said control devices controlling base travel being disposed beneath one opposite pair of said arms, and said control devices controlling the elevation of said seat being disposed beneath the other opposite pair of said arms, each of said control devices being engaged and actuated by its associate arm whenever said standard is tilted in that direction.

* * * * *